US009788120B2

(12) United States Patent
Miyasaka et al.

(10) Patent No.: US 9,788,120 B2
(45) Date of Patent: Oct. 10, 2017

(54) AUDIO PLAYBACK DEVICE AND AUDIO PLAYBACK METHOD

(71) Applicant: SOCIONEXT INC., Yokohama, Kanagawa (JP)

(72) Inventors: Shuji Miyasaka, Osaka (JP); Kazutaka Abe, Osaka (JP); Anh Tuan Tran, Singapore (SG); Yong Hwee Sim, Singapore (SG); Zong Xian Liu, Singapore (SG)

(73) Assignee: Socionext Inc., Kanagawa (JP)

( * ) Notice: Subject to any disclaimer, the term of this patent is extended or adjusted under 35 U.S.C. 154(b) by 0 days.

(21) Appl. No.: 14/961,739

(22) Filed: Dec. 7, 2015

(65) Prior Publication Data

US 2016/0088393 A1 Mar. 24, 2016

Related U.S. Application Data

(63) Continuation of application No. PCT/JP2014/000868, filed on Feb. 19, 2014.

(30) Foreign Application Priority Data

Jun. 10, 2013 (JP) ..... 2013-122254

(51) Int. Cl.
*H04R 5/02* (2006.01)
*H04R 5/04* (2006.01)
(Continued)

(52) U.S. Cl.
CPC ..... *H04R 5/04* (2013.01); *H04S 7/30* (2013.01); *H04S 7/308* (2013.01); *H04R 1/403* (2013.01);
(Continued)

(58) Field of Classification Search
CPC ..... G10L 19/008; G10L 19/22; G10L 19/20; H04S 1/007; H04S 3/02; H04S 2400/03;
(Continued)

(56) References Cited

U.S. PATENT DOCUMENTS

2005/0105442 A1 5/2005 Melchior et al.
2006/0098830 A1* 5/2006 Roeder ..... H04S 3/002 381/310
(Continued)

FOREIGN PATENT DOCUMENTS

CN 1826838 A 8/2006
JP 2001-197598 A 7/2001
(Continued)

OTHER PUBLICATIONS

International Search Report (ISR) issued in International Application No. PCT/JP2014/000868 dated Mar. 18, 2014 with English translation.
(Continued)

*Primary Examiner* — Leshui Zhang
(74) *Attorney, Agent, or Firm* — McDermott Will & Emery LLP

(57) ABSTRACT

An audio playback device which plays back an audio object including an audio signal and playback position information indicating a position in a three-dimensional space at which a sound image of the audio signal is localized, includes: at least one speaker array; a converting unit which converts playback position information to corrected playback position information which is information indicating a position of the sound image on a two-dimensional coordinate system based on a position of the at least one speaker array; and a signal processing unit which localizes the sound image of the audio signal included in the audio object according to the corrected playback position information.

14 Claims, 16 Drawing Sheets

(51) Int. Cl.
*H04S 7/00* (2006.01)
*H04R 3/12* (2006.01)
*H04R 1/40* (2006.01)

(52) U.S. Cl.
CPC ..... *H04R 3/12* (2013.01); *H04R 2203/12* (2013.01); *H04S 2400/03* (2013.01); *H04S 2400/11* (2013.01)

(58) Field of Classification Search
CPC ..... H04S 2420/07; H04S 3/00; H04S 3/002; H04S 3/004; H04S 5/00; H04S 5/005; H04S 5/02; H04R 5/00; H04R 25/00; H04H 40/81; H04H 40/72
USPC ..... 381/1, 10, 11, 12, 13, 17–23, 300–308, 381/310–311, 26, 59, 61, 62, 63, 77, 78, 381/80, 81, 82, 85, 118, 119, 116, 117, 381/120; 700/94
See application file for complete search history.

(56) References Cited

U.S. PATENT DOCUMENTS

2006/0120533 A1 6/2006 Chen
2008/0008326 A1 1/2008 Reichelt et al.
2008/0013746 A1 1/2008 Reichelt et al.
2008/0226084 A1* 9/2008 Konagai ..... H04S 3/008 381/17
2009/0034772 A1 2/2009 Iida et al.
2011/0144783 A1 6/2011 Reichelt et al.
2012/0070021 A1* 3/2012 Yoo ..... H04S 3/002 381/306
2014/0064517 A1* 3/2014 Ko ..... H04R 3/04 381/98

FOREIGN PATENT DOCUMENTS

JP 2006-128818 A 5/2006
JP 2011-035784 A 2/2011
JP 2011-066868 A 3/2011
WO 2006/030692 A1 3/2006
WO 2013/006338 A2 1/2013

OTHER PUBLICATIONS

K. Hamasaki et aL, "Multichannel Sound System for Ultra High-Definition TV", first published in SMPTE Technical Conference Publication, Oct. 2007.
Dolby Atmos Cinema Technical Guidelines, pp. 1-20.
C. Cheng et aL, "Introduction to Head-Related Transfer Functions (HRTFs): Representations of HRTFs in Time, Frequency, and Space", J. Audio Eng. Soc., vol. 49, No. 4, Apr. 2001, pp. 231-249.
Y. A. Huang et al., Audio Signal Processing for Next-Generation Multimedia Communication Systems, Jan. 2004, pp. 323-345.
S. Spors et al., "Physical and Perceptual Properties of Focused Sources in Wave Field Synthesis", Audio Engineering Society Convention Paper, presented at the 127th Convention Oct. 9-12, 2009, pp. 1-19.
Chinese Office Action issued in Application No. 201480032404.7 dated Aug. 1, 2016, with partial English translation.

* cited by examiner

AUDIO PLAYBACK DEVICE AND AUDIO PLAYBACK METHOD

CROSS REFERENCE TO RELATED APPLICATION

This is a continuation application of PCT International Application No. PCT/JP2014/000868 filed on Feb. 19, 2014, designating the United States of America, which is based on and claims priority of Japanese Patent Application No. 2013-122254 filed on Jun. 10, 2013. The entire disclosures of the above-identified applications, including the specifications, drawings and claims are incorporated herein by reference in their entirety.

FIELD

The present disclosure relates to a device and a method for playing back an audio object using one or more speaker arrays. The present disclosure relates particularly to a device and a method for playing back an audio object including playback position information indicating a position at which a sound image is to be localized in a three-dimensional space.

BACKGROUND

In recent years, many digital television broadcast receivers and DVD players for playing back 5.1ch audio content items have been developed and prepared for the market. Here, "5.1ch" is a channel setting for arranging front left and right channels, a front center channel, and left and right surround channels. Some of recent Blu-ray (registered trademark) players have a 7.1ch configuration in which left and right back surround channels are added.

On the other hand, with further increases in the sizes of image screens and in the definitions of images, virtual surround of audio objects has been vigorously studied. For example, virtual surround in the case where 22.2ch speakers are arranged has been studied. FIG. 14 illustrates a speaker arrangement in the case of 22.2ch audio playback that has been currently researched and developed by Japan Broadcasting Corporation (Nippon Hoso Kyokai, NHK). The speaker arrangement is a three-dimensional configuration in which speakers are arranged also on a floor (the lowermost plane) and on a ceiling (the uppermost plane) in FIG. 14, unlike a conventional speaker arrangement in which speakers are arranged only on a two-dimensional plane (the middle plane) in FIG. 14.

In addition, effort for differentiating movie theaters using three-dimensional acoustic effects have been vigorously made (Non-patent Literature 2). In this case, speakers are arranged also on a ceiling in a three-dimensional (3D) configuration. Here, content items are coded as audio objects. An audio object is an audio signal with playback position information indicating, in a three-dimensional space, the position at which a sound image is to be localized. For example, an audio object is a coded signal of a pair of (i) playback position information indicating the position at which a sound source (sound image) is localized in the form of coordinates (x, y, z) along three axes and (ii) an audio signal of the sound source.

For example, when creating an audio object of any of a bullet, an airplane, and a note of a flying bird, etc., the position indicated by playback position information is caused to transit with time from one minute to the next. In this case, the playback position information may be vector information indicating a transition direction. In the case of an explosion sound etc. generated at a certain position, playback position information is naturally constant.

In this way, playback of audio signals with playback position information has been researched and developed on the premise that speakers are arranged three-dimensionally. However, it is impossible to arrange speakers three-dimensionally in many cases for actual home use or personal use.

As a technique for enabling audio playback with higher-possible realistic sensations under an environment where speakers cannot be arranged freely, a method using a head related transfer function (HRTF), wavefront synthesis, and beam forming, etc. have been researched and developed.

The HRTF is a transfer function for simulating propagation property of a sound around the head of a listener. A perception of a sound arrival direction is said to be affected by the HRTF. As illustrated in FIG. 15, the perception is mainly affected by a binaural sound pressure difference and a time difference of sound waves reaching both ears. Conversely, it is possible to control a sound arrival direction by artificially controlling these differences by signal processing. Details for this are described in Non-patent Literature 3. Clues related to localization in the back and forth and perpendicular directions are said to be included in HRTF amplification spectra. Details for this are described in Non-patent Literature 1.

The basic operation principle of the wavefront synthesis is as illustrated in (*a*) of FIG. 16. Since sound waves are concentrically diffused about a sound source (expect for the case where a speaker is arranged at the position of the sound source), it is impossible to generate natural sound waves in space. However, by arranging a plurality of speakers in a column (to form a speaker array) and appropriately controlling the sound pressures and phases, it is possible to generate, in a space, a part of concentric waveforms of sound waves that are virtually diffused from the sound source. Details for this are described in Non-patent Literature 4.

The basic operation principle of the beam forming is as illustrated in (*b*) of FIG. 16. Similar to the case of the wavefront synthesis, the beam forming uses a speaker array, and by appropriately controlling sound pressures and phases, it is possible to make the sound pressure level at a certain position higher than those in the surrounding area. By doing so, it is possible to reproduce a state where the sound source is virtually present at the position. Details for this are described in Non-patent Literature 5.

CITATION LIST

Patent Literature

PTL 1
International Publication No. 2006/030692

Non Patent Literature

NPL 1
First published in SMPTE Technical Conference Publication in October, 2007
NPL 2
Dolby Atmos Cinema Technical Guidelines
NPL 3
Audio Eng Soc, Vol 49, No 4, 2001 April Introduction to Head-Related Transfer Functions (HRTFs): Representations of HRTFs in Time, Frequency, and Space

NPL 4

Audio Signal Processing for Next-Generation Multimedia Communication Systems, pp. 323-342, Y. A. Huang, J. Benesty, Kluwer, January 2004

NPL 5

AES 127th Convention, New York N.Y., USA, 2009, Oct. 9-12 Physical and Perceptual Properties of Focused Sources in Wave Field Synthesis

SUMMARY

Technical Problem

There is a problem that it is difficult to produce, in actual home use or personal use, a configuration in which speakers are arranged on a ceiling as in the 22.2ch configuration described above.

Methods for providing highly realistic sound even in the case where speakers cannot be freely arranged include the method using an HRTF, the wavefront synthesis, and beam forming. The method using an HRTF is excellent as a method for controlling a sound arrival direction, but does not reproduce any sensation of distance between a listener and a sound source because the method using an HRTF is merely for performing control for creating the acoustic signal that perceptually sounds from the direction and thus does not reproduce actual physical wavefronts. On the other hand, the wavefront synthesis and the beam forming can reproduce actual physical wavefronts, and thus can reproduce a sensation of distance between the listener and the sound source, but cannot generate the sound source behind the listener. This is because the sound waves output from the speaker array reach the ears of the listener before the sound waves form a sound image.

In addition, since each of the conventional techniques is a technique for controlling a sound on the two-dimensional plane on which the speakers are arranged, it is impossible to perform signal processing reflecting playback position information when the playback position information included in the audio object is represented as three-dimensional space information.

The present disclosure has been made in view of the conventional problems, and has an object to provide an audio playback device and an audio playback method for playing back an audio object including three-dimensional playback position information with highly realistic sensations even in a space where speakers cannot be arranged freely.

Solution to Problem

In order to solve the above-described problems, an audio playback device according to an embodiment is an audio playback device which plays back an audio object including an audio signal and playback position information indicating a position in a three-dimensional space at which a sound image of the audio signal is localized, the audio playback device including: at least one speaker array which converts an acoustic signal to acoustic vibration; a converting unit configured to convert the playback position information to corrected playback position information which is information indicating a position of the sound image on a two-dimensional coordinate system based on a position of the at least one speaker array; and a signal processing unit configured to localize the sound image of the audio signal included in the audio object according to the corrected playback position information.

With this configuration, since the three-dimensional playback position information included in the audio object is converted into the corrected playback position information on the two-dimensional coordinate system based on the position of the at least one speaker array, and the sound image is localized according to the corrected playback position information, it is possible to play back the audio object with highly realistic sensations even when there is a restriction on the arrangement of the at least one speakers.

Here, when (i) a direction in which speaker elements are arranged in each of the at least one speaker array is an X axis, (ii) a direction which is orthogonal to the X axis and parallel to a setting surface on which the at least one speaker array is arranged is a Y axis, and (iii) a direction which is orthogonal to the X axis and perpendicular to the setting surface is a Z axis, the corrected playback position information may indicate the position at coordinates (x, y) on the two-dimensional coordinate system expressed by the X axis and the Y axis, and when the position identified by the playback position information is expressed by coordinates (x, y, z), the corrected playback position information may indicate values corresponding to x and y.

In this case, since the corrected playback position information indicates values according to the x-coordinate value and the y-coordinate value when the position identified by the playback position information is expressed by (x, y, z), it is possible to play back the audio object including the three-dimensional playback position information with highly realistic sensations even in a space where the speakers cannot be arranged three-dimensionally.

In addition, when, on the two-dimensional coordinate system, (i) a y coordinate located behind the speaker array is a negative coordinate and a y coordinate located in front of the speaker array is a positive coordinate, and (ii) an x coordinate located to a left of a center of the speaker array is a negative coordinate and an x coordinate located to a right of the center of the speaker array is a positive coordinate, a value of the corrected playback position information may be a value obtained by multiplying at least one of the x-coordinate value and the y-coordinate value by a predetermined value.

In this case, since the values of the corrected playback position information are obtained by multiplying the at least one of the coordinates (x, y) by the predetermined value, the recognizable size of the area can be virtually changed.

In addition, an x-coordinate value of the corrected playback position information may be limited to a width of the at least one speaker array.

In this case, the x-coordinate value of the corrected playback position information is a value limited to the width of the at least one speaker array, it is possible to perform signal processing suitable for the performance of the at least one speaker array.

In addition, the signal processing unit may be a beam forming unit configured to form a sound image at the position on the two-dimensional coordinate system.

In this case, since strong acoustic vibration is generated by the beam forming unit at a target position, it is possible to generate a sound field in which a sound source is virtually present at the target position.

In addition, when, on the two-dimensional coordinate system, a y coordinate located behind the speaker array is a negative coordinate and a y coordinate located in front of the speaker array is a positive coordinate, and the signal processing unit may be configured to perform wavefront synthesis by signal processing using a Huygens' principle when a y-coordinate value of the corrected playback position information is a negative value.

In this case where the y-coordinate value of the corrected playback position information is the negative value, wavefront synthesis is performed by signal processing using the Huygens' principle. Thus, it is possible to generate a sound field in which a sound source is virtually present at the target position even when the target position of the sound image to be localized is behind the speakers.

In addition, the corrected playback position information may indicate the position on the two-dimensional coordinate system, the position being indicated by (i) a direction angle to the position indicated by the playback position information when seen from a position of a listener listening to an acoustic sound output from the at least one speaker array and (ii) a distance from the position of the listener to the position indicated by the playback position information.

In this way, since the corrected playback position information indicates the position on the two-dimensional coordinate system in the form of the direction angle to the position indicated by the playback position information when seen from the position of the listener and the distance from the position of the listener to the position indicated by the playback position information. Thus, it is possible to control the virtually sensible direction in which the sound source is present with respect to the position of the listener and the virtually sensible distance from the position of the listener to the sound source.

In addition, the signal processing unit may be configured to localize the sound image using a head related transfer function (HRTF), and the HRTF may be set so that a sound may be audible from a direction of the position indicated by the corrected playback position information.

In this case, since the sound image is localized using the HRTF so that the sound is audible from the direction of the position indicated by the corrected playback position information, it is possible to perform playback reflecting the direction to the sound source when the sound is listened to by the listener.

In addition, the signal processing unit may be configured to adjust a sound volume according to the distance from the position of the listener to the position indicated by the corrected playback position information.

In this case, since the sound volume is adjusted according to the distance between the position of the listener and the position indicated by the corrected playback position information, it is possible to perform playback reflecting the distance to the sound source when the sound is listened to by the listener.

In addition, the signal processing unit may be configured to change a signal processing method according to the position indicated by the corrected playback position information.

In this case, since the signal processing method is changed according to the position indicated by the corrected playback position information, it is possible to select an optimum signal processing method according to the target playback position.

In addition, when (i) a direction in which speaker elements are arranged in each of the at least one speaker array is an X axis, (ii) a direction which is orthogonal to the X axis and parallel to a setting surface on which the at least one speaker array is arranged is a Y axis, and (iii) a direction which is orthogonal to the X axis and perpendicular to the setting surface is a Z axis, when, on the two-dimensional coordinate system, a y coordinate located behind the speaker array is a negative coordinate and a y coordinate located in front of the speaker array is a positive coordinate, the signal processing unit may be configured to: when a y-coordinate value of the corrected playback position information is a negative value, perform wavefront synthesis by signal processing using a Huygens' principle; when a y-coordinate value of the corrected playback position information is a positive value indicating a position in front of a listener, generate a sound image by signal processing using beam forming; and when a y-coordinate value of the corrected playback position information is a positive value indicating a position behind the listener, localize a sound image by signal processing using a head related transfer function (HRTF).

In this case, the signal processing unit (i) performs the wavefront synthesis by signal processing using the Huygens' principle when the y-coordinate value of the corrected playback position information is the negative value, (ii) generates the sound image by signal processing using the beam forming when the y-coordinate value of the corrected playback position information is the positive value indicating the position in front of the listener, and (iii) localizes the sound image by signal processing by using the HRTF when the y-coordinate value of the corrected playback position information is the positive value indicating the position behind the listener. Thus, it is possible to create a sound field where the acoustic vibration is generated and virtually presented at the target position in front of the position of the listener and to perform playback in the sound field where a sound virtually and perceptually approaches from the direction behind the position of the listener.

In addition, the audio playback device may include at least two speaker arrays, wherein each of the at least two speaker arrays forms a corresponding one of at least two two-dimensional coordinate systems, and when the position identified by the playback position information is expressed by coordinates (x, y, z) where (i) a direction in which speaker elements are arranged in one of the at least two speaker arrays is an X axis, (ii) a direction which is orthogonal to the X axis and parallel to a setting surface on which the one of the at least two speaker arrays is arranged is a Y axis, and (iii) a direction which is orthogonal to the X axis and perpendicular to the setting surface is a Z axis, the signal processing unit may be configured to control the at least two speaker arrays according to a z-coordinate value. When the two two-dimensional coordinate systems are parallel to each other, the signal processing unit may be configured to: increase a sound volume of the one of the at least two speaker arrays which is on an upper two-dimensional coordinate system with respect to the setting surface when the z-coordinate value is larger than a predetermined value; and increase a sound volume of the one of the at least two speaker arrays which is on a lower two-dimensional coordinate system with respect to the setting surface when the z-coordinate value is smaller than the predetermined value. When the two two-dimensional coordinate systems are orthogonal to each other, the signal processing unit may be configured to: increase a sound volume of one or more speaker elements in the one of the at least two speaker arrays when the z-coordinate value is larger than a predetermined value, the one or more speaker elements being arranged at positions above a predetermined position on a two-dimensional coordinate system perpendicular to the setting surface among the at least two two-dimensional coordinate systems; and increase a sound volume of one or more speaker elements in the one of the at least two speaker arrays when z-coordinate value is smaller than the predetermined value, the one or more speaker elements being arranged at positions below the predetermined position on the two-dimensional coordinate system perpendicular to the setting surface among the at least two two-dimensional coordinate systems.

In this way, the audio playback device includes the at least two speaker arrays which are controlled according to the value of z in coordinates (x, y, z) indicating the position identified by the playback position information. Thus, it is possible to control the height information of the playback position information, and to play back the audio object including the three-dimensional playback position information with highly realistic sensations.

In addition, an audio playback device according to an embodiment is an audio playback device which plays back an audio object including an audio signal and playback position information indicating a position in a three-dimensional space at which a sound image of the audio signal is localized, wherein the audio object includes an audio frame including the audio signal which is obtained at a predetermined time interval and the playback position information, and when the playback position information of the audio frame included in the audio object is lost, the audio playback device plays back the audio frame by using playback position information included in an audio frame that has been played back previously as playback position information of the audio frame whose playback position information is lost.

In this way, when the playback position information of the current audio frame is lost, the playback position information included in the audio frame that has been previously played back is used. Thus, even when the playback position information of the current audio frame is lost, it is possible to create a natural sound field, or to reduce the amount of information required to record or transmit the audio object when the audio object is not moving.

It is to be noted that other possible embodiments for solving the problems include not only the audio playback device described above but also an audio playback method, a program for executing the audio playback method, and a computer-readable recording medium such as a DVD on which the program is recorded.

Advantageous Effects

The audio playback device and the audio playback method make it possible to play back an audio object including three-dimensional playback position information with highly realistic sensations even in a space in which speakers cannot be freely arranged.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENT

Hereinafter, an embodiment of an audio playback device and an audio playback method is described with reference to the drawings.

It is to be noted that the embodiment described below indicates a preferred specific example. The numerical values, shapes, constituent elements, the arrangement and connection of the constituent elements, the processing order of operations etc. indicated in the following embodiment are mere examples, and therefore do not limit the scope of the present disclosure. Therefore, among the constituent elements in the following embodiment, constituent elements not recited in any one of the independent claims that define the most generic concept of the present disclosure are described as arbitrary constituent elements.

Figure 1:
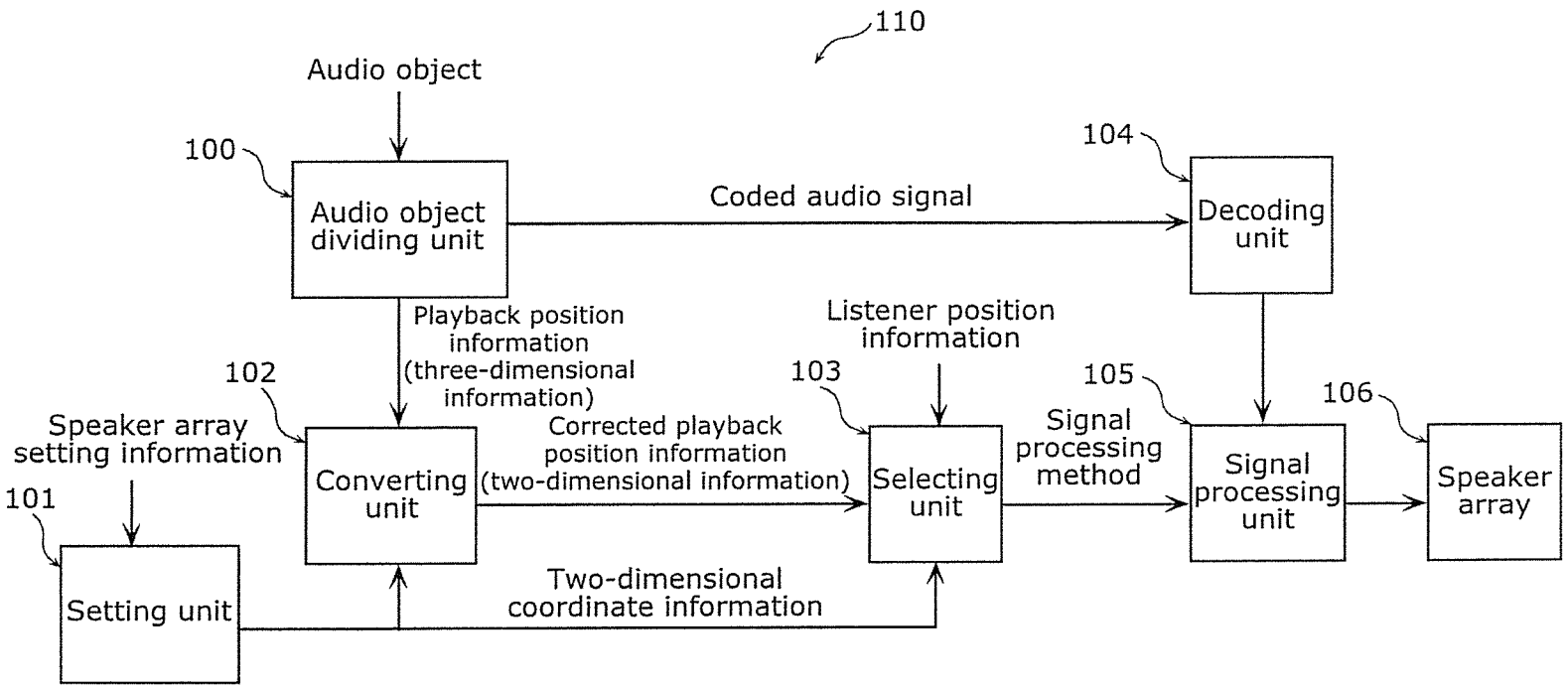
FIG. 1 is a diagram illustrating a configuration of an audio playback device according to an embodiment.

FIG. 1 is a diagram illustrating a configuration of an audio playback device 110 in this embodiment. The audio playback device 110 is an audio playback device which plays back an audio object including an audio signal (here, a coded audio signal) and playback position information indicating, in a three-dimensional space, a position at which a sound image of the audio signal is to be localized. The audio playback device 110 includes: an audio object dividing unit 100; a setting unit 101; a converting unit 102; a selecting unit 103; a decoding unit 104; a signal processing unit 105; and a speaker array 106.

In FIG. 1, the audio object dividing unit 100 is a processing unit which divides an audio object including playback position information and coded audio signal into the playback position information and the coded audio signal.

The setting unit 101 is a processing unit which sets a virtual two-dimensional coordinate system according to a position at which the speaker array 106 is arranged (the two-dimensional coordinate system is determined based on the position of the speaker array 106).

The converting unit 102 is a processing unit which converts the playback position information obtained by the audio object dividing unit 100 into corrected playback position information which is position information (two-dimensional information) on the two-dimensional coordinate system set by the setting unit 101.

The selecting unit 103 is a processing unit which selects a signal processing method that should be employed by the signal processing unit 105, based on the corrected playback position information generated by the converting unit 102; the two-dimensional coordinate system set by the setting unit 101; and the position of a listener listening to an acoustic sound output from the speaker array 106 (the position predetermined by the audio playback device 110).

The decoding unit 104 is a processing unit which decodes the coded audio signal obtained by the audio object dividing unit 100 to generate an audio signal (acoustic signal).

The signal processing unit 105 is a processing which localizes a sound image of the audio signal obtained through the decoding by the decoding unit 104 according to the corrected playback position information obtained through the conversion by the converting unit 102. Here, the signal processing unit 105 performs the processing according to the signal processing method selected by the selecting unit 103.

The speaker array 106 is at least one speaker array (a group of speaker elements arranged in a column) which converts an output signal (the acoustic signal) from the signal processing unit to acoustic vibration.

The audio object dividing unit 100, the setting unit 101, the converting unit 102, the selecting unit 103, the decoding unit 104, the signal processing unit 105 are typically implemented as hardware using electronic circuits such as semiconductor integrated circuits, and alternatively may be implemented as software using one or more programs each executable by a computer including a CPU, a ROM, a RAM, or the like.

Hereinafter, descriptions are given of operations performed by the thus-configured audio playback device 110 according to this embodiment.

Figure 2:
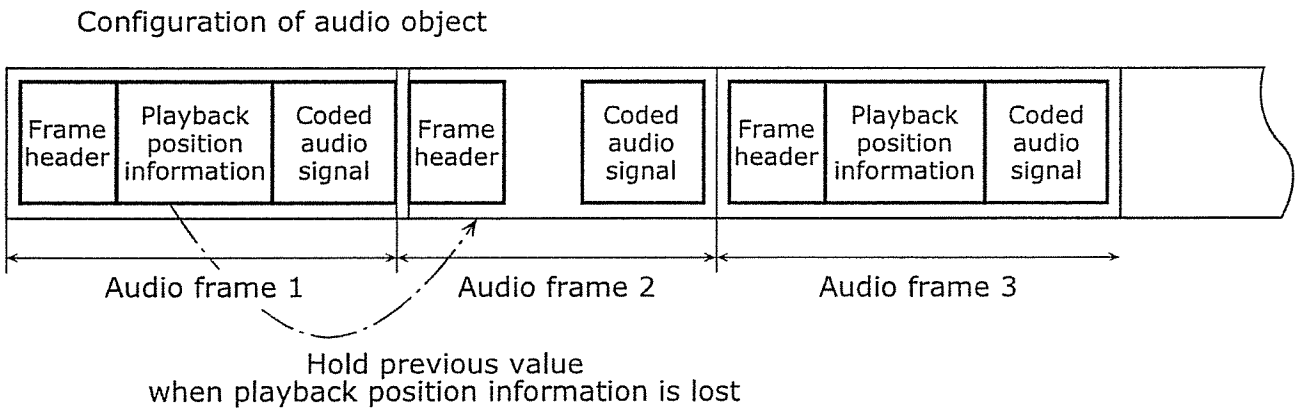
FIG. 2 is a diagram illustrating a configuration of an audio object.

First, the audio object dividing unit 100 divides the audio object including the playback position information and the coded audio signal into the playback position information and the coded audio signal. For example, the audio object has a configuration as illustrated in FIG. 2. More specifically, the audio object is a pair of the coded audio signal and the playback position information indicating, in a three-dimensional space, a position at which a sound image of the coded audio signal is to be localized. These pieces of information (the coded audio signal and the playback position information) coded on a per audio frame basis at a predetermined time interval make up the audio object. Here, the playback position information is three-dimensional information (information indicating the position in the three-dimensional space) obtained in the case where speakers are arranged on a ceiling. The playback position information does not always need to be inserted on a per audio frame basis. In the case of an audio frame whose playback position information is lost, the audio object dividing unit 100 uses playback position information included in an audio frame that has been previously played back. It is possible to reuse the playback position information by using a storage unit included in the audio playback device 110.

The audio object dividing unit 100 extracts the playback position information and the coded audio signal from the audio object as illustrated in FIG. 2.

Figure 3:
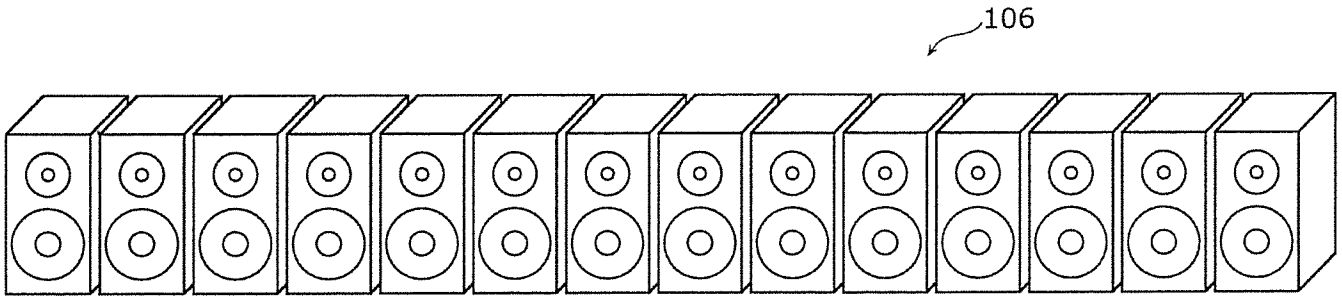
FIG. 3 is a diagram illustrating an example of a shape of a speaker array.
Figure 4A:
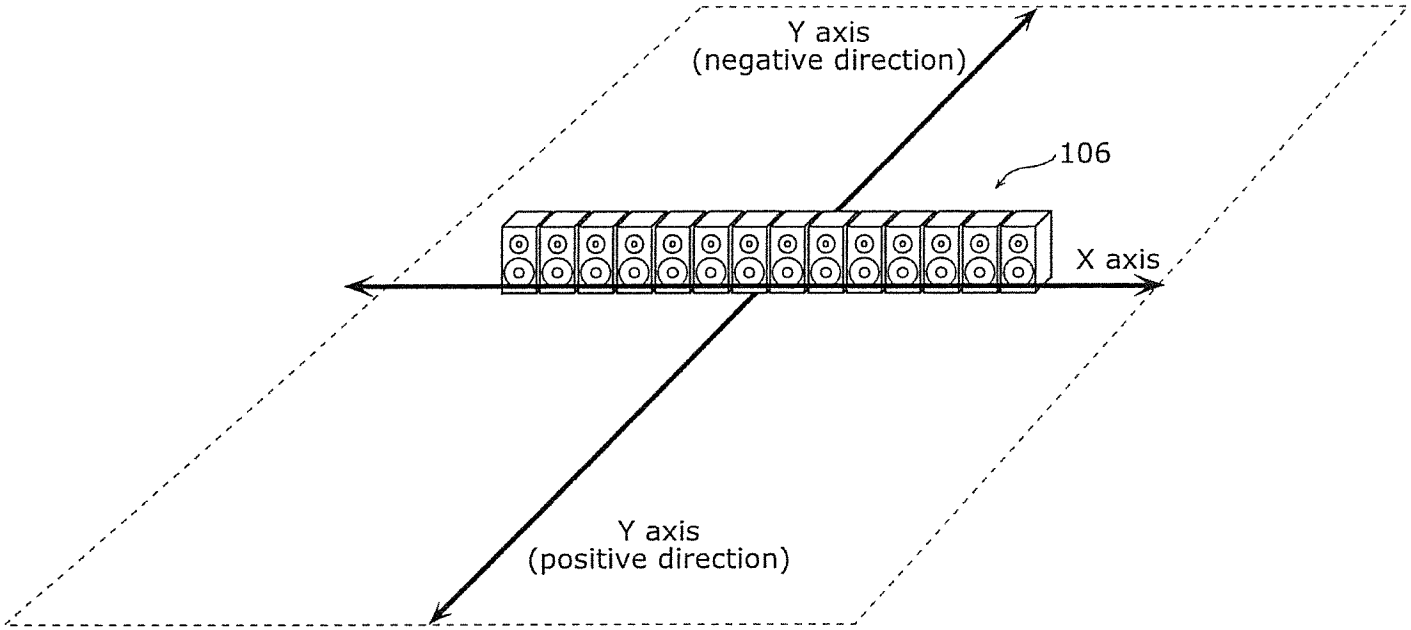
FIG. 4A is a diagram illustrating a relationship between the speaker array and axes of a two-dimensional coordinate system.
Figure 4B:
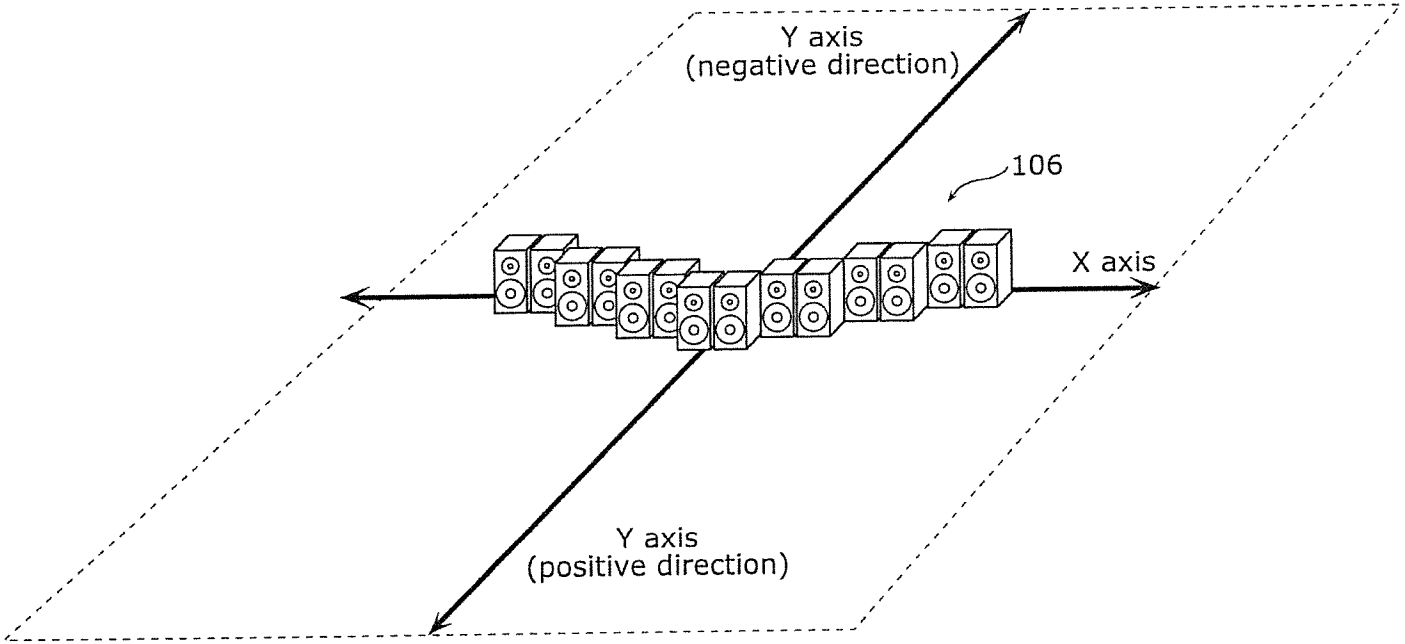
FIG. 4B is a diagram illustrating a relationship between the speaker array arranged differently and axes of a two-dimensional coordinate system.

The setting unit 101 sets a virtual two-dimensional coordinate system according to the position at which the speaker array 106 is arranged. A schematic view of the speaker array 106 is illustrated in FIG. 3, for example. The speaker array 106 is an array of a plurality of speaker elements. As illustrated in FIG. 4A, the setting unit 101 sets a virtual two-dimensional coordinate system according to a position at which the speaker array 106 is arranged (the two-dimensional coordinate system is determined based on the position of the speaker array 106). The two-dimensional coordinate system set here is an X-Y plane in which: the direction in which the speaker elements of the speaker array 106 are arranged is the X axis; and the direction orthogonal to the X axis and horizontal to a setting surface on which the speaker array 106 is arranged is the Y axis. On the two-dimensional coordinate system, (i) a y-coordinate located behind the speaker array 106 is set to a negative coordinate and a y-coordinate located in front of the speaker array 106 is set to a positive coordinate, and (ii) an x-coordinate located to the left of the center of the speaker array 106 is set to a negative coordinate and an x-coordinate located to the right of the center of the speaker array 106 is set to a positive coordinate. The speaker array does not always need to be arranged linearly, and may be arranged in an arch shape as illustrated in, for example, FIG. 4B. In FIG. 4B as a non-limiting example, the respective speaker units (speaker elements) are depicted as if they are oriented to the front of the drawing sheet. However, the respective speaker units (speaker elements) may be arranged to be oriented radially with adjusted angles.

Next, the converting unit 102 converts the three-dimensional playback position information into corrected playback position information which is two-dimensional information. In this embodiment, a two-dimensional coordinate system having the X axis and the Y axis as illustrated in each of FIGS. 4A and 4B is set. Thus, the playback position information is originally mapped at a position on a three-dimensional coordinate system having a Z axis orthogonal to the two-dimensional coordinate plane (the setting surface) having the X axis and the Y axis. Here, the position indicated by the playback position information after the mapping is expressed as (x1, y1, z1). The converting unit 102 converts the position information into two-dimensional corrected playback position information.

Figure 5:
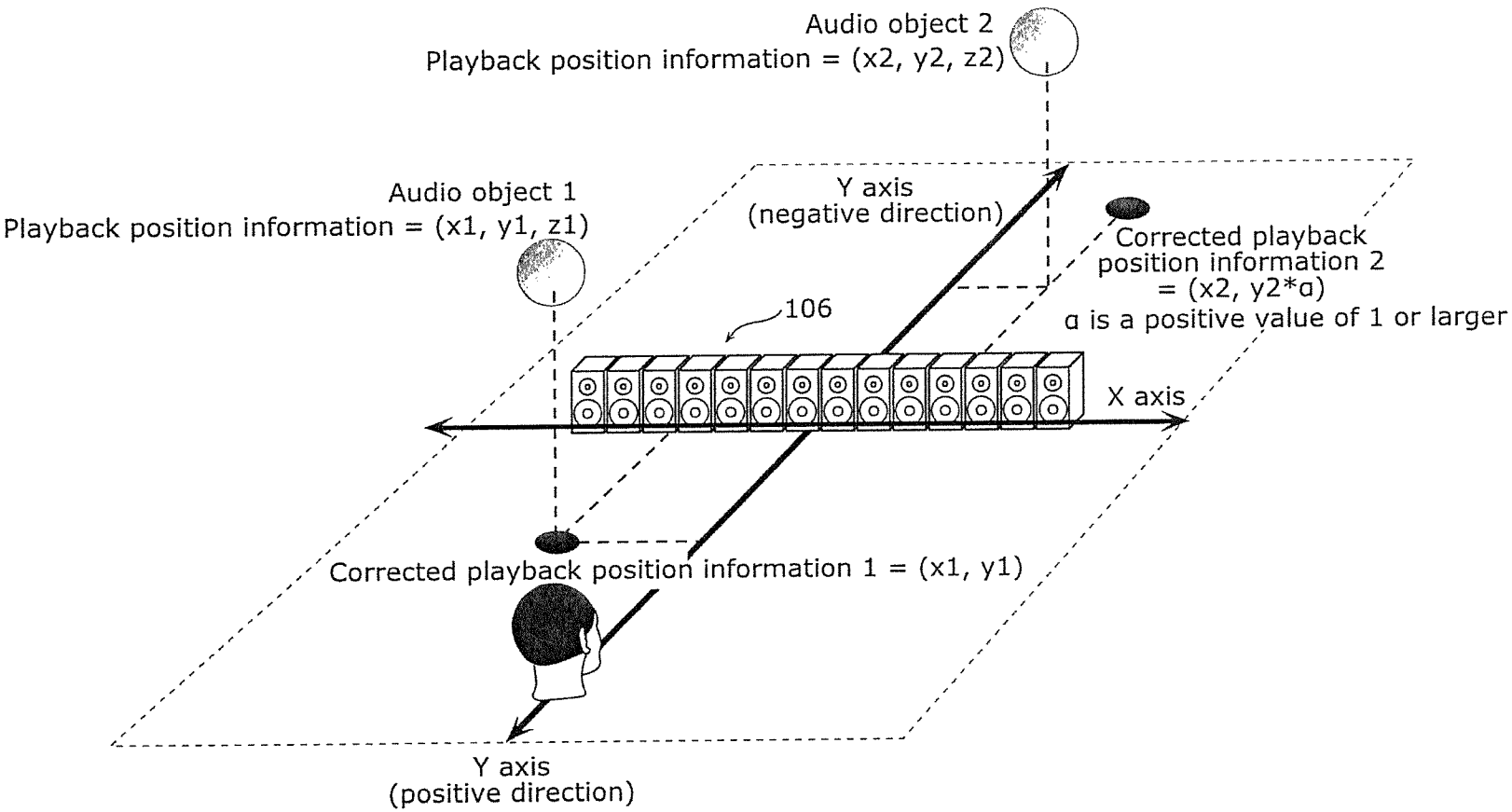
FIG. 5 is a diagram illustrating a relationship between three-dimensional playback position information and corrected playback position information (x, y).

The conversion from the three-dimensional playback position information to the two-dimensional corrected position information is performed, for example, according to one of methods illustrated in FIG. 5. Here, as in the case of an audio object 1, assuming that the position indicated by the playback position information of the audio object 1 is at coordinates (x1, y1, z1), the position indicated by the corrected playback position information corresponding thereto is expressed by (x1, y1). As in the case of an audio object 2, the position indicated by the corrected playback position information corresponds to the position at coordinates (x2, y2, z2) indicated by the playback position information, and does not always need to be the same position at coordinates (x2, y2) as indicated by the x-coordinate value and the y-coordinate value. For example, as in the case of the position at coordinates (x2, y2*a) indicated by corrected playback position information 2 illustrated in FIG. 5, it is also possible to obtain a value larger than the value actually specified by the playback position information by multiplying at least one of the x-coordinate value and the y-coordinate value with at least one value $\alpha$ (predetermined value), so that a wide acoustic space can be produced. In this example, the value in the Y-axis direction is increased, and thus an acoustic effect that the space is virtually expanded in the depth direction is obtainable. On the other hand, the X-axis coordinate may be multiplied with a value β (predetermined value) smaller than 1 according to the restriction in the width of the speaker array 106 (this multiplication is not illustrated in FIG. 5). In other words, the x-coordinate value may be limited to the width of the speaker array 106 (the value may be a value within the width of the speaker array 106).

Figure 6:
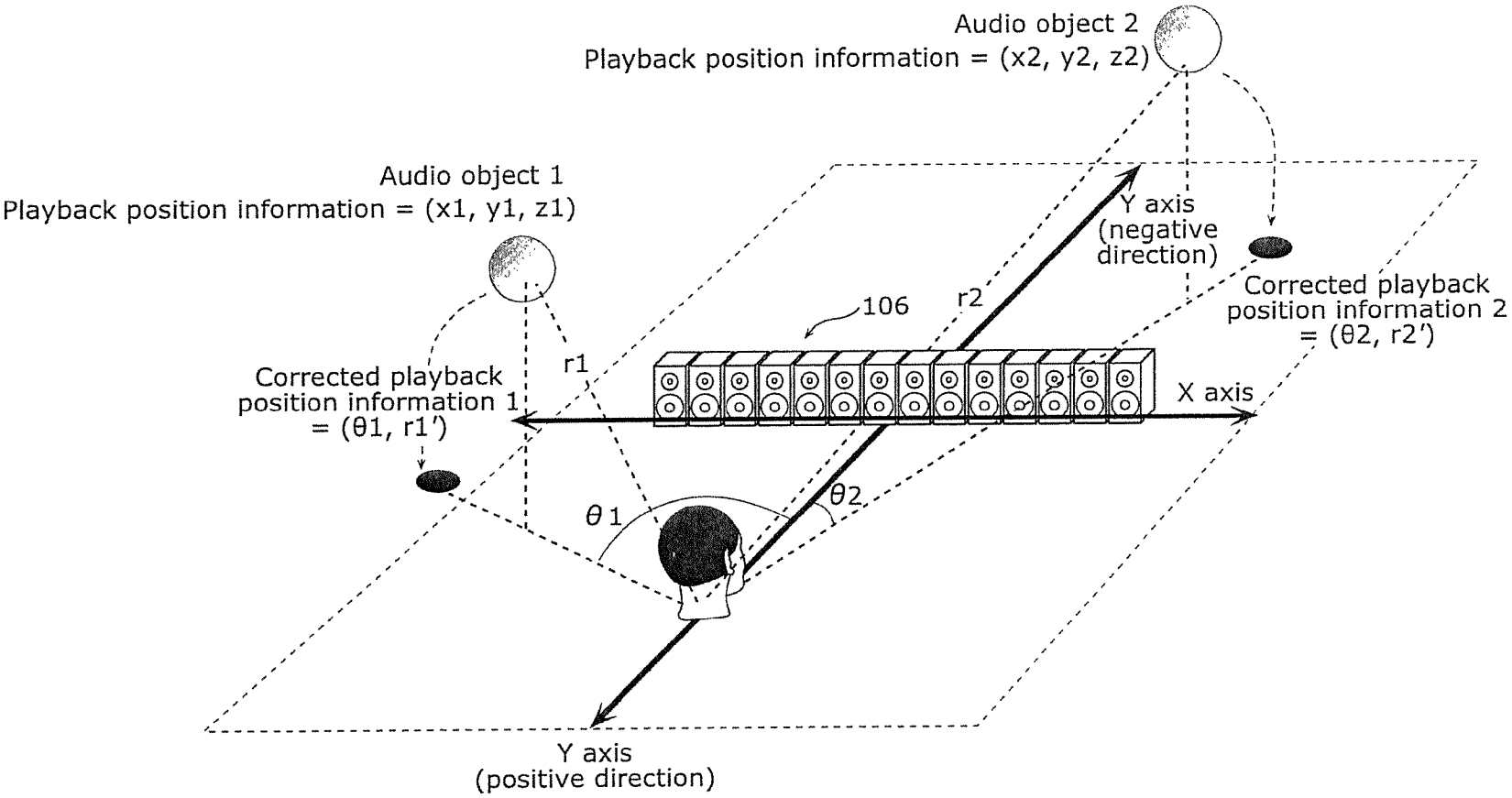
FIG. 6 is a diagram illustrating a relationship between three-dimensional playback position information and corrected playback position information (a direction, a distance).

One of methods illustrated in FIG. 6 may be used as another method for converting three-dimensional playback position information into two-dimensional corrected playback position information. In other words, it is also possible to convert three-dimensional playback position information to information indicating a direction and a distance of the audio object (the position indicated by the playback position information) when seen from the listener. In other words, the corrected playback position information may be a polar coordinate system indicating (i) a direction angle to a position indicated by playback position information when seen from the position of a listener listening to an acoustic signal output from the speaker array 106 and a distance to the position indicated by the playback position information from the position of the listener. In the example of the audio object 1, when the playback position information of the audio object 1 is expressed by (x1, y1, z1), the direction angle to the position at coordinates (x1, y1, z1) when seen from the position of the listener is θ1, and the distance from the position of the listener to the position at coordinates (x1, y1, z1) is r1, corrected playback position information 1 corresponding thereto is expressed as (θ1, r1'). Here, r1' is a value determined depending on r1. In the example of the audio object 2, when the playback position information of the audio object 2 is expressed by (x2, y2, z2), the direction angle to the position at coordinates (x2, y2, z2) when seen from the position of the listener is θ2, and the distance from the position of the listener to the position at coordinates (x2, y2, z2) is r2, corrected playback position information 2 corresponding thereto is expressed as (θ2, r2'). Here, r2' is a value determined depending on r2. In the case of the method using an HRTF as the method for localizing the sound image, the presentation by the polar coordinate system of the corrected playback position information simplifies the signal processing because an HRTF filter coefficient is set using, as a clue, direction information from the listener.

In FIG. 6, r1' is determined according to r1. The value of r1' may be controlled to be closer to r1 as θ1 is closer to 0 degree and to be smaller than r1 as θ1 is closer to 90 degrees.

The signal processing unit 105 may perform processing for localizing a sound image according to the method using an HRTF set so that sound is audible from the direction of the position indicated by the corrected playback position information. In this way, it is possible to control the virtually sensible direction in which the sound source is present with respect to the position of the listener and the virtually sensible distance from the position of the listener to the sound source. Furthermore, the signal processing unit 105 may adjust a sound volume according to the distance (r1', r2', etc.) from the position of the listener and the position indicated by the corrected playback position information. In this way, it is possible to perform playback reflecting the virtually sensible distance from the listener to the sound source.

Figure 7:
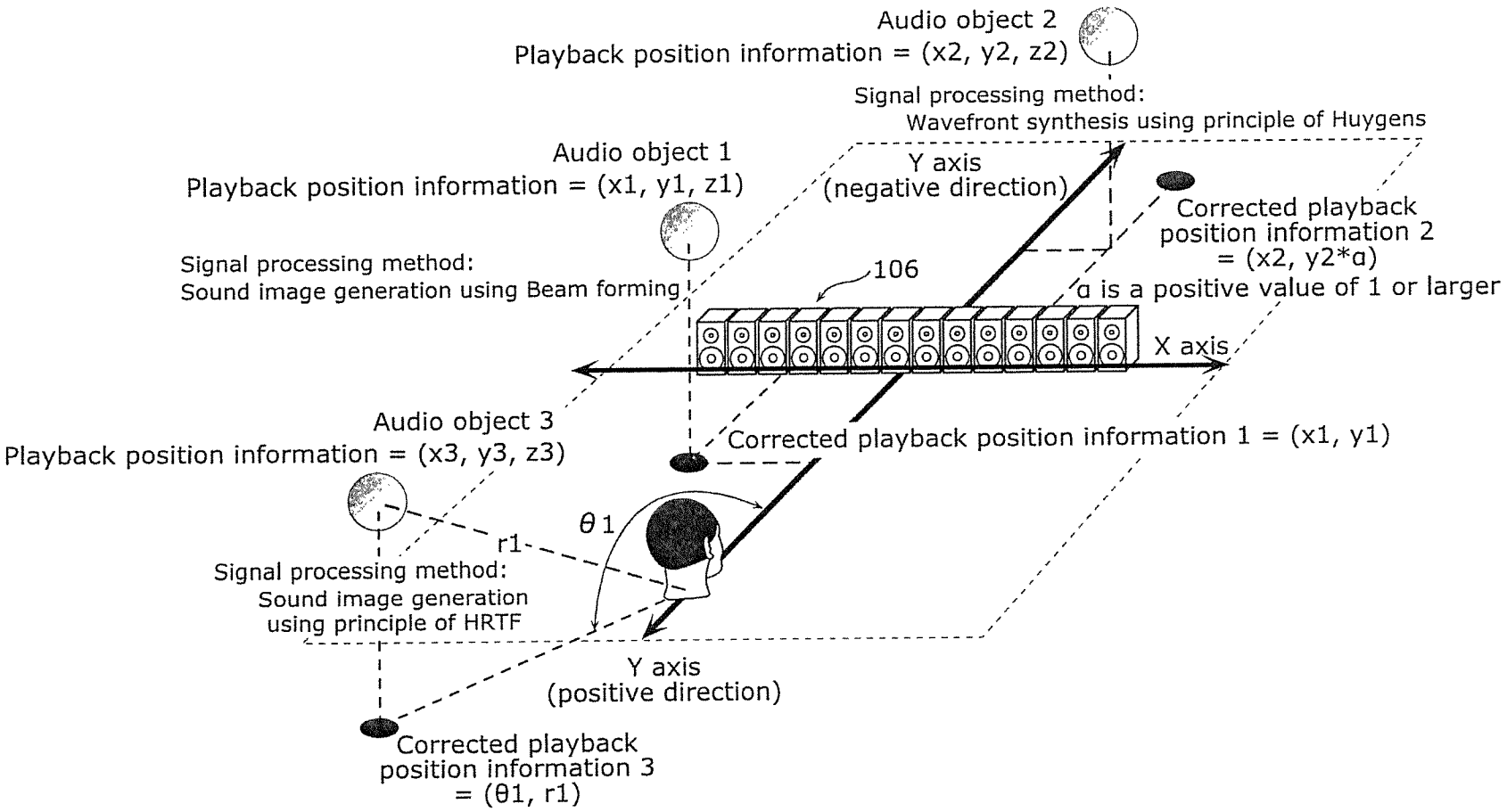
FIG. 7 is a diagram illustrating a relationship between the corrected playback position information and signal processing methods.

Next, the selecting unit 103 selects the signal processing method that should be employed by the signal processing unit 105 based on (i) the corrected playback position information generated by the converting unit 102, (ii) the two-dimensional coordinate system set by the setting unit 101, and (iii) the position of the listener (or the listener's listening position predetermined by the audio playback device 110). FIG. 7 illustrates an example thereof. For example, in the case of the audio object 1 (in the case where the y-coordinate value of corrected playback position information is a positive value indicating a position in front of the listener), a sound image is synthesized at the position of the corrected playback position information 1 using the beam forming. The use of the beam forming makes it possible to form the sound image when the playback position of the sound source is in front of the speaker array 106 and in front of the listener. In the case of the audio object 2 (in the case where the y-coordinate value of corrected playback position information is a negative value indicating a position behind the listener), a sound image is synthesized using the wavefront synthesis based on the Huygens' principle regarding, as the sound source, the position of the corrected playback position information 2. The use of the wavefront synthesis makes it possible to form an acoustic effect that the sound source is virtually present at the position behind the speaker array 106 when the playback position of the sound source behind the speaker array 106. In the case of an audio object 3 (in the case where the y-coordinate value of corrected playback position information is a positive value indicating a position behind the listener), a sound image is localized according to the method using an HRTF as if the sound is audible from the direction (θ1) indicated by corrected playback position information. The method using an HRTF is selected because the beam forming and the wavefront synthesis are not effective when the playback position of the sound source is behind the position of the listener. The use of the method using an HRTF makes it possible to present a direction with high precision but does not possible to present a distance sensation. Thus, it is also possible to control a sound volume according to the distance r1 to the sound source.

On the other hand, the coded audio signal obtained by the audio object dividing unit 100 is decoded into an audio PCM signal by the decoding unit 104. The decoding unit 104 may be any decoder conforming to a codec method used to code the coded audio signal.

The audio PCM signal decoded in this way is processed by the signal processing unit 105 according to the signal processing method selected by the selecting unit 103. More specifically, the signal processing unit 105 (i) performs the wavefront synthesis by signal processing using the Huygens' principle when the y-coordinate value of the corrected playback position information is a negative value, (ii) generates a sound image by signal processing using the beam forming when the y-coordinate value of the corrected playback position information is a positive value indicating a position in front of the listener, and (iii) localizes a sound image by signal processing according to the method using an HRTF when the y-coordinate value of the corrected playback position information is a positive value indicating a position behind the listener.

In this embodiment, the signal processing method is any one of the beam forming, the wavefront synthesis, and the method using an HRTF. Any of the signal processing methods can be specifically performed using a conventional signal processing method.

Lastly, the speaker array 106 converts the output signal (acoustic signal) from the signal processing unit 105 into acoustic vibration.

Figure 8:
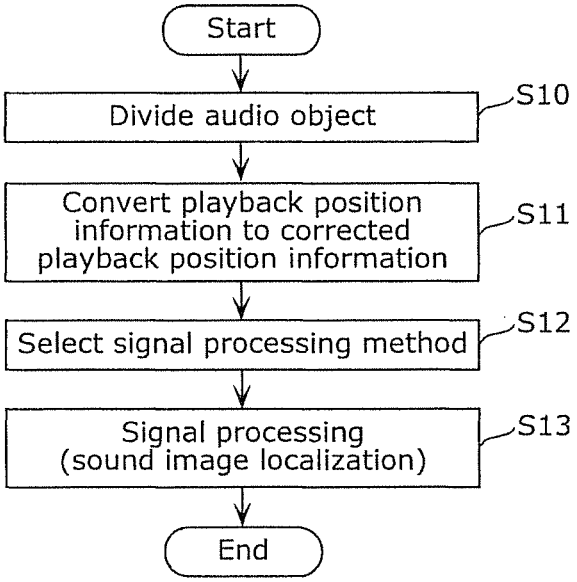
FIG. 8 is a flowchart of main operations performed by an audio playback device according to the embodiment.

FIG. 8 is a flowchart of main operations performed by an audio playback device 110 in the embodiment.

First, the audio object dividing unit 100 divides an audio object into three-dimensional playback position information and a coded audio signal (S10).

Next, the converting unit 102 converts the three-dimensional playback position information obtained by the audio object dividing unit 100 into corrected playback position information which is position information (two-dimensional information) on the two-dimensional coordinate system based on the position of the speaker array 106 (S11).

Next, the selecting unit 103 selects a signal processing method that should be employed by the signal processing unit 105, based on the corrected playback position information generated by the converting unit 102; the two-dimensional coordinate system set by the setting unit 101; and the position of a listener listening to an acoustic sound output from the speaker array 106 (the position may be a listener's position predetermined by the audio playback device 110) (S12).

Lastly, the signal processing unit 105 localizes the sound image of the audio signal obtained by the audio object dividing unit 100 and then decoded by the decoding unit 104, according to the corrected playback position information obtained through the conversion by the converting unit 102 (S13). At this time, the signal processing unit 105 performs the processing using the signal processing method selected by the selecting unit 103.

In this way, the three-dimensional playback position information included in the audio object is converted into the corrected playback position information on the two-dimensional coordinate system based on the position of the speaker array, and the sound image is localized according to the corrected playback position information. Thus, even when there is a restriction on the arrangement of the speaker array, the audio object can be played back with highly realistic sensations.

FIG. 8 illustrates four steps S10 to S13 as main operation steps, but it is only necessary that the converting step S11 and the signal processing step S13 be executed as minimum steps. Through these two steps, the three-dimensional playback position information is converted into the corrected playback position information on the two-dimensional coordinate system. Thus, even in a space in which speakers cannot be freely arranged, an audio object including three-dimensional playback position information can be played back with highly realistic sensations.

Alternatively, in addition to the steps S10 to S13 illustrated in FIG. 8, an operation by the setting unit 101 and an operation by the decoding unit 104 may be added as operations by the audio playback device 110 in this embodiment.

Figure 9:
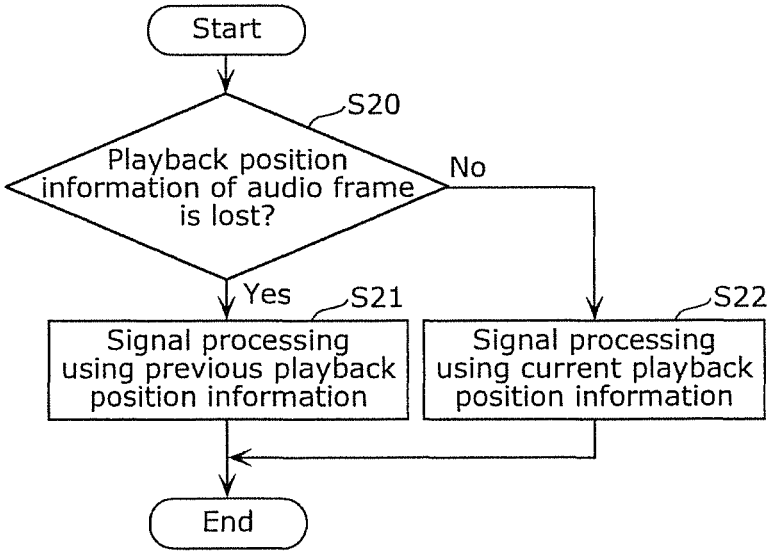
FIG. 9 is a flowchart illustrating operations related to handling of corrected playback position information included in an audio frame, among operations performed by an audio playback device in the embodiment.

FIG. 9 is a flowchart illustrating operations related to handling of playback position information included in an audio frame, among operations performed by the audio playback device 110 in the embodiment. FIG. 9 indicates operations related to playback position information performed for each audio frame included in the audio object.

The audio object dividing unit 100 determines whether playback position information of a current audio frame is lost (S20).

When it is determined that the playback position information is lost (Yes in S20), playback position information included in an audio frame that has been previously played back is used by the audio object dividing unit 100 as a replacement for the playback position information of the current audio frame, and signal processing is performed by the signal processing unit 105 according to the playback position information (after conversion to two-dimensional corrected playback position information) (S21).

When it is determined that the playback position information is not lost (No in S20), playback position information included in a current audio frame is divided by the audio object dividing unit 100, and signal processing is performed by the signal processing unit 105 according to the playback position information (after conversion to two-dimensional corrected playback position information) (S22).

In this way, since the playback position information included in the audio frame that has been previously played back is used even when the playback position information of the current audio frame is lost, it is possible to naturally play back a sound in a sound field, or to reduce the amount of information required to record or transmit the audio object when the audio object does not move.

It is to be noted that the procedures according to the flowcharts of FIGS. 8 and 9 and the variations thereof can be implemented as one or more programs in which the procedures are written and executed by one or more processors.

Figure 10:
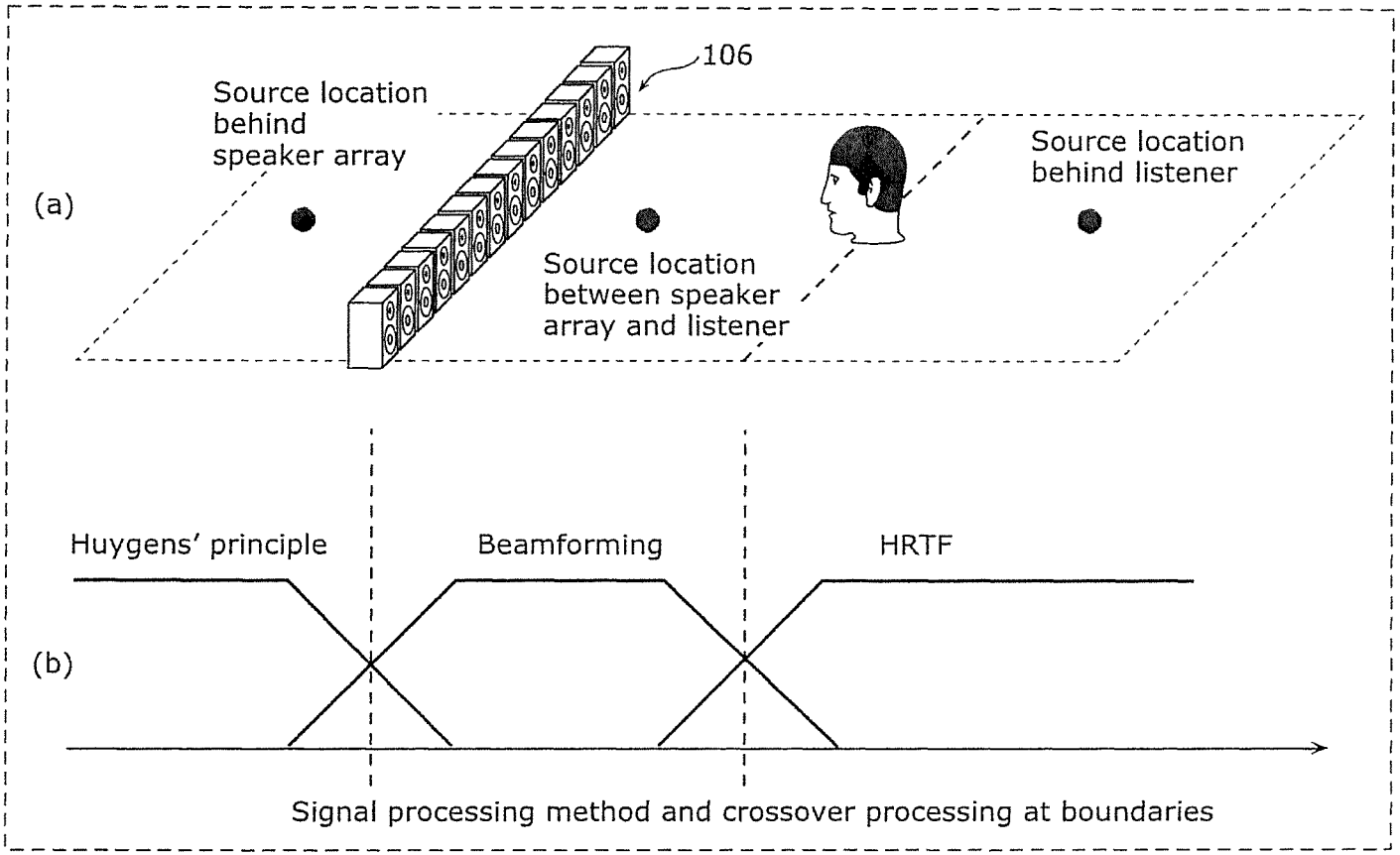
FIG. 10 is a diagram illustrating a relationship between the positions of audio objects and signal processing methods.

In this embodiment, one of the three signal processing methods is selected according to the corrected playback position information. In FIG. 10, (*a*) is a diagram schematically illustrating cases in each of which one of the three signal processing methods is selected as below. The wavefront synthesis using the Huygens' principle is used when corrected playback position information is behind the speaker array, the beam forming is selected when the corrected playback position information is in front of the speaker array and in front of the listener, and the method using an HRTF is used when the corrected playback position information is behind the listener. In FIG. 10, (*b*) illustrates the signal processing methods around boundaries therebetween in the case where an audio object (the position indicated by playback position information included in the audio object) moves with time. For example, when corrected playback position information is around the speaker array, the signal processing unit 105 generates a signal in which a signal output using the wavefront synthesis and a signal output using the beam forming are mixed at a predetermined ratio. On the other hand, when corrected playback position information is around the listener, the signal processing unit 105 generates a signal in which a signal output using the beam forming and a signal output according to the method using an HRTF are mixed at a predetermined ratio.

Figure 11:
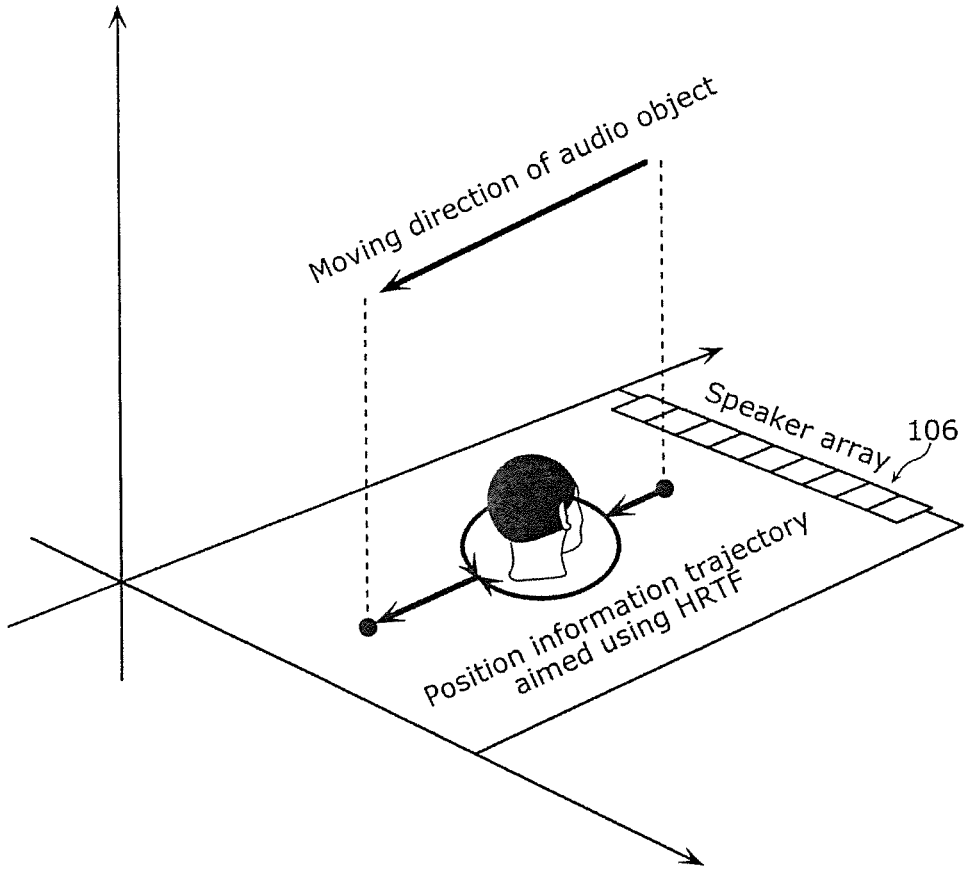
FIG. 11 is a diagram illustrating a signal processing method in the case where an audio object passes above the head of a listener.

Alternatively, although one of the three signal processing methods is selected according to the corrected playback position information in this embodiment, the method using an HRTF may be selected irrespective of the position of the corrected playback position information. The method using an HRTF can be selected in any of the cases because it enables control in any of the cases by simulating binaural phase difference information, binaural level difference information, and an acoustic transfer function around the head of the listener. On the other hand, the wavefront synthesis using the Huygens' principle does not enable localization of a sound image in front of the speaker array, and the beam forming does not enable localization of a sound image behind the speaker array and behind the listener. FIG. 11 illustrates a trajectory of position information aimed by the method using an HRTF in the case where an audio object (the position indicated by playback position information included in the audio object) passes above the head of the listener. The audio object (the position indicated by playback position information included in the audio object) is controlled to surround the head of the listener when the audio object is about to reach the head of the listener. Such control increases realistic sensations above and around the head of the listener.

Although control in a Z-axis direction is not described in this embodiment, it is also possible to add the control to the method using an HRTF utilizing the result of study (Patent Literature 1) that a clue for localization in a perpendicular direction is included in an amplification spectrum of an acoustic transfer function around the head of the listener.

Figure 12:
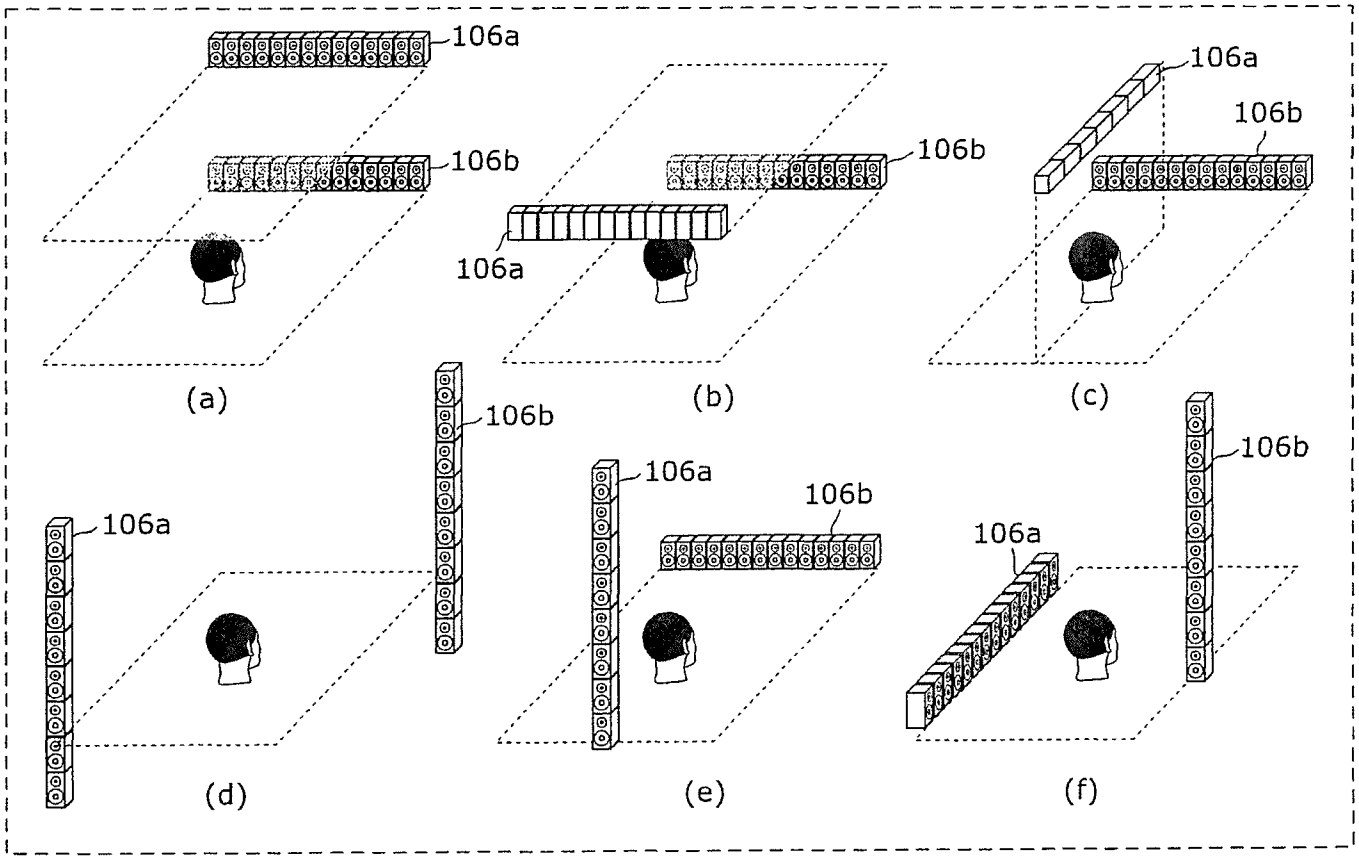
FIG. 12 is a diagram illustrating a variation of the embodiment, in which two speaker arrays are used.
Figure 13:
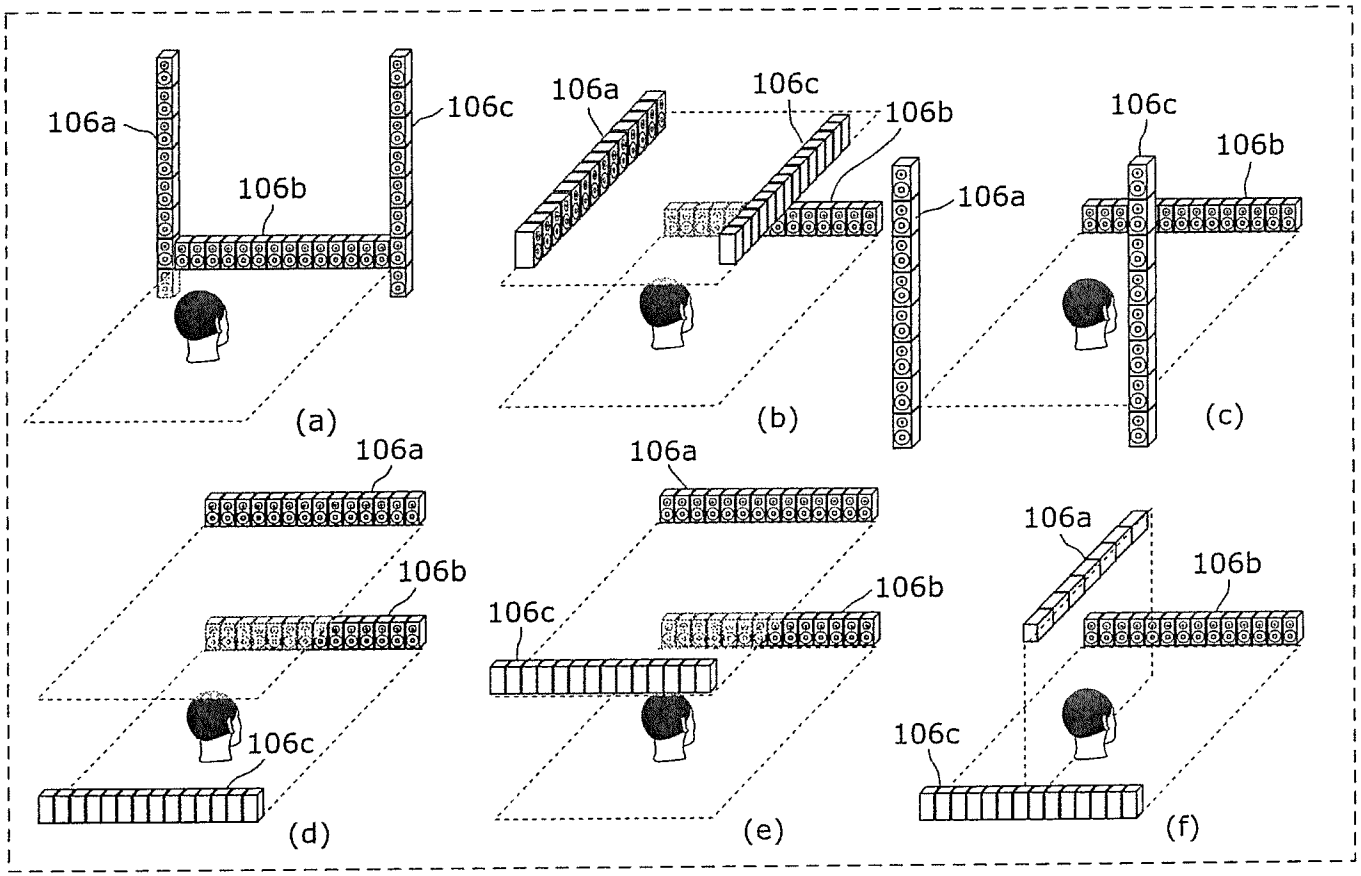
FIG. 13 is a diagram illustrating a variation of the embodiment, in which three speaker arrays are used.
Figure 14:
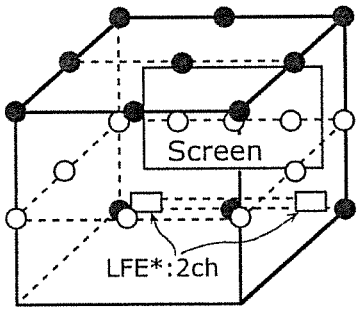
FIG. 14 Prior Art
FIG. 14 is a diagram illustrating an example of 22.2ch speaker arrangement in the conventional art.
Figure 15:
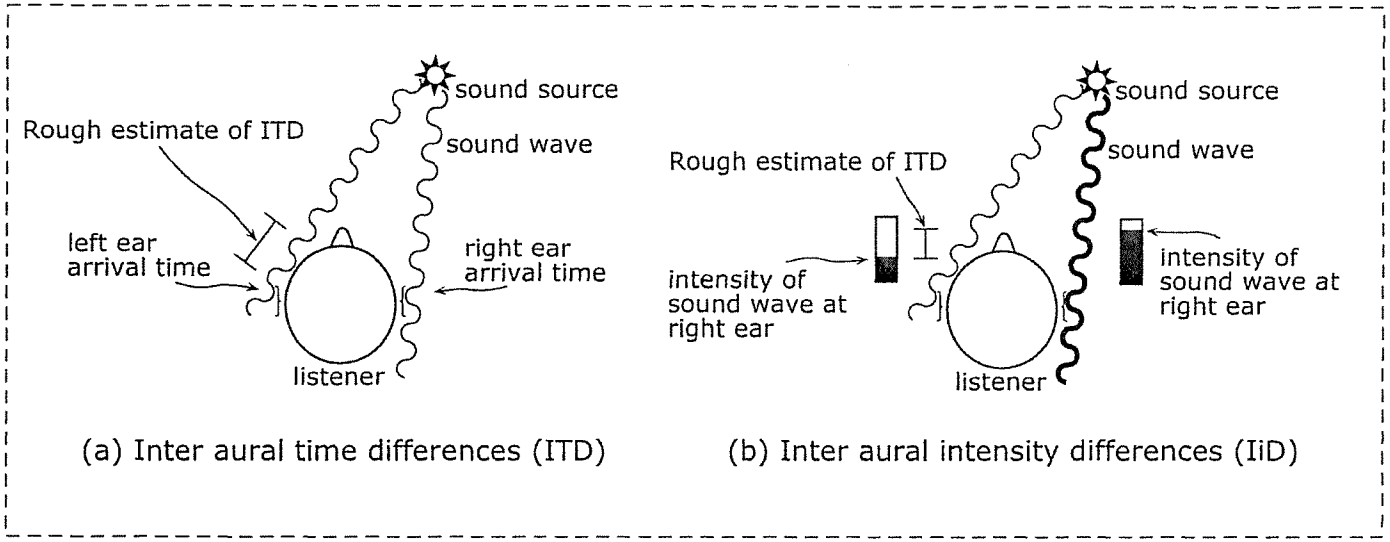
FIG. 15 Prior Art
FIG. 15 is a diagram illustrating the principle of HRTF in the conventional art.
Figure 16:
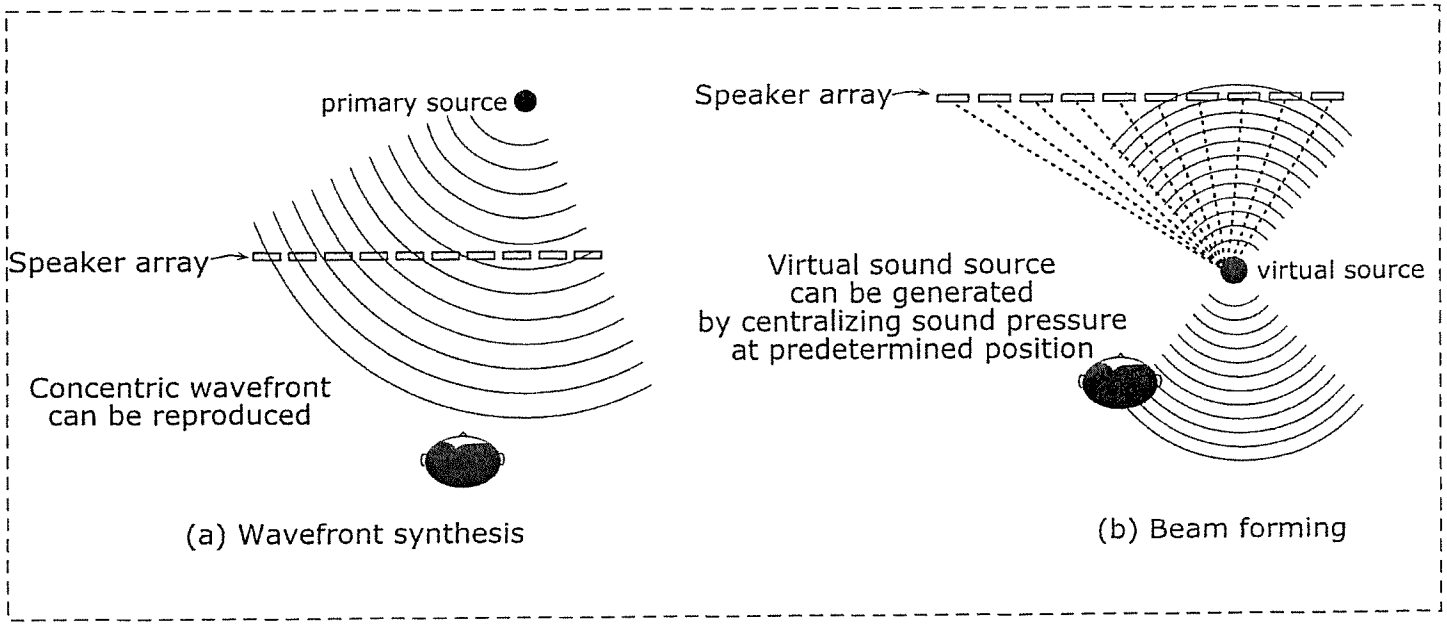
FIG. 16 Prior Art
FIG. 16 indicates the principles of wavefront synthesis and beam forming in the conventional art.

Alternatively, control in a Z-axis direction may be performed by creating a plurality of coordinate planes using a plurality of speaker arrays. FIG. 12 illustrates variations each using two speaker arrays 106*a* and 106*b*. FIG. 13 illustrates variations each using three speaker arrays 106*a* to 106*c*.

In each of the examples in FIGS. 12 and 13, the audio playback device includes at least two speaker arrays each of which forms a corresponding one of at least two two-dimensional coordinate systems. When a position identified by playback position information is expressed by (x, y, z), the signal processing unit 105 controls the at least two speaker arrays according to the value of z. In the case where the at least two two-dimensional coordinate systems are parallel to each other, the signal processing unit 105 increases the sound volume of the speaker array on an upper two-dimensional coordinate system with respect to the X-Y plane (setting surface) among the at least two speaker arrays when the value of z is larger than (or no smaller than) a predetermined value; and increases the sound volume of the speaker array on a lower two-dimensional coordinate system with respect to the X-Y plane (setting surface) among the at least two speaker arrays when the value of z is smaller than (or no larger than) the predetermined value.

In another case where two two-dimensional coordinate systems are orthogonal to each other, the signal processing unit 105 increases the sound volume of one or more speaker elements in the one of the at least two speaker arrays when the value of z is larger than (or no smaller than) a predetermined value, the one or more speaker elements being arranged at positions above a predetermined position on a two-dimensional coordinate system perpendicular to the X-Y plane (setting surface) among the at least two two-dimensional coordinate systems, and increases the sound volume of one or more speaker elements in the one of the at least two speaker arrays when the value of z is smaller than (or no larger than) the predetermined value, the one or more speaker elements being arranged at positions below the predetermined position on the two-dimensional coordinate system perpendicular to the X-Y plane (setting surface) among the at least two two-dimensional coordinate systems.

In this way, when the audio playback device 110 includes at least two speaker arrays, since the at least two speaker arrays are controlled according to the value of z in coordinates (x, y, z) indicating the position identified by the playback position information, height information of the playback position information can be controlled, and the audio object including the three-dimensional playback position information can be played back with highly realistic sensations.

As described above, the audio playback device 110 in this embodiment includes: the at least one speaker array 106 which converts an acoustic signal into acoustic vibration; the converting unit 102 which converts the three-dimensional playback position information into position information (corrected playback position information) based on the position of the speaker array 106 on the two-dimensional coordinate system; and the signal processing unit 105 which localizes the sound image of the audio object according to the corrected playback position information. Thus, the audio playback device 110 is capable of playing back the audio object with the three-dimensional playback position information with optimum realistic sensations even in an environment where speakers cannot be freely arranged, specifically, no speaker can be set on a ceiling.

Although the audio playback devices according to aspects of the present invention has been described above based on the embodiment and variations thereof, audio playback devices disclosed herein are not limited to the embodiment and variations thereof. The present disclosure covers various modifications that a person skilled in the art may conceive and add to the exemplary embodiment or any of the variations or embodiments obtainable by arbitrarily combining different embodiments based on the present disclosure.

Although the setting unit 101 is included in this embodiment, the setting unit 101 is unnecessary when the setting position of the speaker array is determined in advance.

Although listener position information is input to the selecting unit 103 in this embodiment, the listener position information does not need to be input when the position of the listener is determined in advance, or the position determined in advance by the device is fixed.

The selecting unit 103 is also unnecessary when a signal processing method is fixed (for example, it is determined that processing is always performed according to the method using an HRTF).

Although the decoding unit 104 is included in this embodiment, the decoding unit 104 is unnecessary when the coded audio signal is a simple PCM signal, in other words, the audio signal included in the audio object is not coded.

Although the audio object dividing unit 100 is included in this embodiment, the audio object dividing unit 100 is unnecessary when an audio object having a structure in which an audio signal and playback position information are divided is input to the audio playback device 110.

In addition, speaker elements do not always need to be arranged linearly in the speaker array, and may be arranged in an arch (arc) shape, for example. The intervals between speaker elements do not always need to be equal. The present disclosure does not limit the shape of each of speaker arrays.

INDUSTRIAL APPLICABILITY

The audio playback device according to the present disclosure has one or more speaker arrays, and is particularly capable of playing back an audio object including three-dimensional position information with highly realistic sensations even in a space in which speakers cannot be arranged three-dimensionally. Thus, the audio playback device is widely applicable to devices for playing back audio signals.

The invention claimed is:

1. An audio playback device which plays back an audio object including an audio signal and playback position information indicating a position in a three-dimensional space at which a sound image of the audio signal is localized, the audio playback device comprising:

at least one speaker array which includes speaker elements and converts an acoustic signal to acoustic vibration;

a converting unit configured to convert the playback position information to corrected playback position information which is information indicating a position of the sound image on a two-dimensional coordinate system based on a position of the at least one speaker array; and a signal processing unit configured to localize the sound image of the audio signal included in the audio object according to the corrected playback position information, and output the localized sound image to the at least one speaker array, wherein:

when (i) a direction in which the speaker elements are arranged in each of the at least one speaker array is an X axis, (ii) a direction which is orthogonal to the X axis and parallel to a setting surface on which the at least one speaker array is arranged is a Y axis, and (iii) a direction which is orthogonal to the X axis and perpendicular to the setting surface is a Z axis, the corrected playback position information indicates the position at coordinates (x, y) on the two-dimensional coordinate system expressed by the X axis and the Y axis, and when the position identified by the playback position information is expressed by coordinates (x, y, z), the corrected playback position information indicates values corresponding to x and y, on the two-dimensional coordinate system, a y coordinate located behind the at least one speaker array is a negative coordinate and a y coordinate located in front of the at least one speaker array is a positive coordinate, the signal processing unit is configured to perform wavefront synthesis by signal processing using a Huygens' principle when a y-coordinate value of the corrected playback position information is a negative value, and the signal processing unit is a beam forming unit configured to form a sound image at the position on the two-dimensional coordinate system when the y-coordinate value of the corrected playback position information is a positive value.

2. The audio playback device according to claim 1, wherein when, on the two-dimensional coordinate system, (i) a y coordinate located behind the at least one speaker array is a negative coordinate and a y coordinate located in front of the at least one speaker array is a positive coordinate, and (ii) an x coordinate located to a left of a center of the at least one speaker array is a negative coordinate and an x coordinate located to a right of the center of the at least one speaker array is a positive coordinate, a value of the corrected playback position information is a value obtained by multiplying at least one of the x-coordinate value and the y-coordinate value by a predetermined value.

3. The audio playback device according to claim 1, wherein an x-coordinate value of the corrected playback position information is limited to a width of the at least one speaker array.

4. The audio playback device according to claim 1, wherein the corrected playback position information indicates the position on the two-dimensional coordinate system, the position on the two-dimensional coordinate system being indicated by (i) a direction angle to the position indicated by the corrected playback position information when seen from a position of a listener listening to an acoustic sound output from the at least one speaker array and (ii) a distance from the position of the listener to the position indicated by the corrected playback position information.

5. The audio playback device according to claim 4, wherein the signal processing unit is configured to localize the sound image using a head related transfer function (HRTF), and the HRTF is set so that a sound is audible from a direction of the position indicated by the corrected playback position information.

6. The audio playback device according to claim 5, wherein the signal processing unit is configured to adjust a sound volume according to the distance from the position of the listener to the position indicated by the corrected playback position information.

7. The audio playback device according to claim 1, wherein the signal processing unit is configured to change a signal processing method according to the position indicated by the corrected playback position information.

8. The audio playback device according to claim 1, wherein:

the audio playback device includes a processor and a memory storing a program, and the program, when executed by the processor, causes the processor to function as the converting unit and the signal processing unit.

9. The audio playback device according to claim 1, further comprising at least two speaker arrays, wherein each of the at least two speaker arrays forms a corresponding one of at least two two-dimensional coordinate systems, and when the position identified by the playback position information is expressed by coordinates (x, y, z) where (i) a direction in which speaker elements are arranged in one of the at least two speaker arrays is an X axis, (ii) a direction which is orthogonal to the X axis and parallel to a setting surface on which the one of the at least two speaker arrays is arranged is a Y axis, and (iii) a direction which is orthogonal to the X axis and perpendicular to the setting surface is a Z axis, the signal processing unit is configured to control the at least two speaker arrays according to a z-coordinate value.

10. The audio playback device according to claim 8, wherein, when the two two-dimensional coordinate systems are parallel to each other, the signal processing unit is configured to:

increase a sound volume of the one of the at least two speaker arrays which is on an upper two-dimensional coordinate system with respect to the setting surface when the z-coordinate value is larger than a predetermined value; and increase a sound volume of the one of the at least two speaker arrays which is on a lower two-dimensional coordinate system with respect to the setting surface when the z-coordinate value is smaller than the predetermined value.

11. The audio playback device according to claim 9, wherein when the two two-dimensional coordinate systems are orthogonal to each other, the signal processing unit is configured to:

increase a sound volume of one or more speaker elements in the one of the at least two speaker arrays when the z-coordinate value is larger than a predetermined value, the one or more speaker elements being arranged at positions above a predetermined position on a two-dimensional coordinate system perpendicular to the setting surface among the at least two two-dimensional coordinate systems; and increase a sound volume of one or more speaker elements in the one of the at least two speaker arrays when z-coordinate value is smaller than the predetermined value, the one or more speaker elements being arranged at positions below the predetermined position on the two-dimensional coordinate system perpendicular to the setting surface among the at least two two-dimensional coordinate systems.

12. An audio playback device which plays back an audio object including an audio signal and playback position information indicating a position in a three-dimensional space at which a sound image of the audio signal is localized, the audio playback device comprising:

at least one speaker array which includes speaker elements and converts an acoustic signal to acoustic vibration;

a converting unit configured to convert the playback position information to corrected playback position information which is information indicating a position of the sound image on a two-dimensional coordinate system based on a position of the at least one speaker array; and a signal processing unit configured to localize the sound image of the audio signal included in the audio object according to the corrected playback position information, and output the localized sound image to the at least one speaker array, wherein when (i) a direction in which the speaker elements are arranged in each of the at least one speaker array is an X axis, (ii) a direction which is orthogonal to the X axis and parallel to a setting surface on which the at least one speaker array is arranged is a Y axis, and (iii) a direction which is orthogonal to the X axis and perpendicular to the setting surface is a Z axis, when, on the two-dimensional coordinate system, a y coordinate located behind the at least one speaker array is a negative coordinate and a y coordinate located in front of the at least one speaker array is a positive coordinate, and the signal processing unit is configured to:

when a y-coordinate value of the corrected playback position information is a negative value, perform wavefront synthesis by signal processing using a Huygens' principle;

when a y-coordinate value of the corrected playback position information is a positive value indicating a position in front of a listener, generate a sound image by signal processing using beam forming; and when a y-coordinate value of the corrected playback position information is a positive value indicating a position behind the listener, localize a sound image by signal processing using a head related transfer function (HRTF).

13. An audio playback method for playing back, using a speaker array including speaker elements, an audio object including an audio signal and playback position information indicating a position in a three-dimensional space at which a sound image of the audio signal is localized, the audio playback method comprising:

converting the playback position information to corrected playback position information which is information indicating a position of the sound image on a two-dimensional coordinate system based on a position of the at least one speaker array; and localizing the sound image of the audio signal included in the audio object according to the corrected playback position information, and outputting the localized sound image to the at least one speaker array, wherein when (i) a direction in which the speaker elements are arranged in each of the at least one speaker array is an X axis, (ii) a direction which is orthogonal to the X axis and parallel to a setting surface on which the at least one speaker array is arranged is a Y axis, and (iii) a direction which is orthogonal to the X axis and perpendicular to the setting surface is a Z axis, the corrected playback position information indicates the position at coordinates (x, y) on the two-dimensional coordinate system expressed by the X axis and the Y axis, and when the position identified by the playback position information is expressed by coordinates (x, y, z), the corrected playback position information indicates values corresponding to x and y, on the two-dimensional coordinate system, a y coordinate located behind the at least one speaker array is a negative coordinate and a y coordinate located in front of the at least one speaker array is a positive coordinate, in the localizing, wavefront synthesis is performed by signal processing using a Huygens' principle when a y-coordinate value of the corrected playback position information is a negative value, and in the localizing, a sound image at the position on the two-dimensional coordinate system is localized by signal processing using beam forming when the y-coordinate value of the corrected playback position information is a positive value.

14. An audio playback method for playing back, using at least one speaker array including speaker elements, an audio object including an audio signal and playback position information indicating a position in a three-dimensional space at which a sound image of the audio signal is localized, the audio playback method comprising:

converting the playback position information to corrected playback position information which is information indicating a position of the sound image on a two-dimensional coordinate system based on a position of the at least one speaker array; and localizing the sound image of the audio signal included in the audio object according to the corrected playback position information, and outputting the localized sound image to the at least one speaker array, wherein when (i) a direction in the speaker elements are arranged in each of the at least one speaker array is an X axis, (ii) a direction which is orthogonal to the X axis and parallel to a setting surface on which the at least one speaker array is arranged is a Y axis, and (iii) a direction which is orthogonal to the X axis and perpendicular to the setting surface is a Z axis, when, on the two-dimensional coordinate system, a y coordinate located behind the at least one speaker array is a negative coordinate and a y coordinate located in front of the at least one speaker array is a positive coordinate, and in the localizing:

when a y-coordinate value of the corrected playback position information is a negative value, wavefront synthesis is performed by signal processing using a Huygens' principle;

when a y-coordinate value of the corrected playback position information is a positive value indicating a position in front of a listener, a sound image is generated by signal processing using beam forming; and when a y-coordinate value of the corrected playback position information is a positive value indicating a position behind the listener, a sound image is localized by signal processing using a head related transfer function (HRTF).

* * * * *